US007039332B2

(12) United States Patent
Suzuki

(10) Patent No.: US 7,039,332 B2
(45) Date of Patent: May 2, 2006

(54) IMAGE FORMING APPARATUS

(75) Inventor: Kazuhiro Suzuki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/793,009

(22) Filed: Mar. 5, 2004

(65) Prior Publication Data

US 2005/0196186 A1 Sep. 8, 2005

(51) Int. Cl.
*G03G 15/20* (2006.01)

(52) U.S. Cl. ..... 399/45; 399/69; 219/216

(58) Field of Classification Search ..... 399/45, 399/67, 69, 328; 219/216
See application file for complete search history.

(56) References Cited

U.S. PATENT DOCUMENTS 5,893,019 A * 4/1999 Yoda et al. ..... 399/328
6,219,498 B1 * 4/2001 Katoh et al. ..... 399/45
6,327,444 B1 * 12/2001 Hachisuga ..... 399/45
6,459,877 B1 * 10/2002 Yoda et al. ..... 219/216
6,687,468 B1 * 2/2004 Holubek et al. ..... 399/45
2003/0128994 A1 * 7/2003 Holubek et al. ..... 399/45

FOREIGN PATENT DOCUMENTS

JP 11-249487 A 9/1999
JP 2000-19886 A 1/2000
JP 2002-214961 A 7/2002

* cited by examiner

*Primary Examiner*—G. Bradley Bennett
(74) *Attorney, Agent, or Firm*—Foley & Lardner LLP

(57) ABSTRACT

In order to change over heating temperature and pressing force of a fixing device to heat, press and fix images on recording media, an image forming apparatus of this invention has a changeover portion to change over a heating temperature and a pressing force by the same indicating operation. Operator is not required to perform the heating temperature changeover operation and the pressing force changeover operation separately. Thus, the operability of the heat press and fixing device in changing over the fixing condition of the heating pressing and fixing device for the heat roller 20 and the press roll 21 is improved.

4 Claims, 7 Drawing Sheets

IMAGE FORMING APPARATUS

BACKGROUND OF THE INVENTION

1. Field of the Invention

This invention relates to an image forming apparatus such as copying machine, printer, facsimile, etc. equipped with a fixing device to heat, press and fix unfixed toner images or multi-functional image forming apparatus commonly provided with these image forming units and an image forming method.

2. Description of the Related Art

As a fixing device that is used in electro-photographic copy machine, printer, facsimile or multi-functional peripheral (hereinafter abbreviated to MFP), there is a fixing device to heat, press and fix unfixed toner images by inserting a recording medium between fixing roller pair comprising a heating roller and a press roller or similar fixing belts.

In such a fixing device, when a fixing temperature and pressing force are always at constant levels, fixation may differ depending upon such characteristics as thickness, shape or material of recording media. When heating and pressing to a recording medium are excessive at the time of fixing, the recording medium may shrink or wrinkle and on the other hand, when heating and pressing are insufficient, the fixing become defective and deterioration of image quality resulted.

Therefore, a heating pressure fixing device is disclosed in Japanese Patent Application No. 2000-19886. This fixing device is capable of switching a fixing temperature, a pressing force between fixing rollers or both of them to optimum levels according to moisture content in recording media.

In the conventional fixing roller device described above, specific operations when changing fixing conditions according to moisture contents in recording media are not disclosed. However, in similar apparatus, while fixing temperatures are changed through a control panel, pressing force was generally switched by changing the position of the lever of a pressure mechanism provided to fixing rollers. In other words, to change a fixing temperature and pressure force of a heating pressure fixing device to optimum levels, it was so far necessary for operator to execute two operates; not only the operation through the control panel but also the lever operation of a pressure mechanism.

So, an image forming apparatus capable of making easy to operate when changing fixing temperature and pressure force to get fixed images of good quality by a heating pressure fixing device and easily obtaining a good fixing is desired.

SUMMARY OF THE INVENTION

It is an object of this invention to provide an image forming apparatus equipped with a hot pressure fixing device capable of making the operation by operator easy to change fixing conditions suited to various kinds of recording media and easily obtaining a high quality of fixed image.

According to an embodiment of this invention, the image forming apparatus is composed of: an image forming unit to form unfixed toner images on plural recording media; a fixing roller pair to hold and convey the recording media; a pressing member to press contact the fixing roller pair each other with a specified pressing force; a heating member to heat the fixing roller pair; and a changeover portion to change the pressing force by the pressing member and a heating temperature by the heating member by the same indicating operation.

Further, according to the embodiment of this invention, in an image forming method wherein fixed toner images are obtained on plural recording media having unfixed toner images with a fixing roller pair press contacted mutually by a specified pressing force at a specified heating temperature by holding and conveying, the pressing force and the heating temperature are changed over to specified conditions by the same indicating operation.

Further, according to the embodiment of this invention, an image forming apparatus is composed of: an image forming unit to form unfixed toner images on plural kinds of recording media; a fixing roller pair to convey the recording media by holding them; a pressure changeover unit to change over the pressing force applied to the fixing roller pair; a heating member to heat the fixing roller pair; a key operating portion to select a specified recording medium from the plural kinds of recording media; and a controller to change over the pressing force by the pressure changeover unit and a heating temperature of the heating member according to the recording medium selected by the key operating portion.

DETAILED DESCRIPTION OF THE INVENTION

A preferred embodiment of this invention will be explained in detail referring to the attached drawings.

Figure 1:
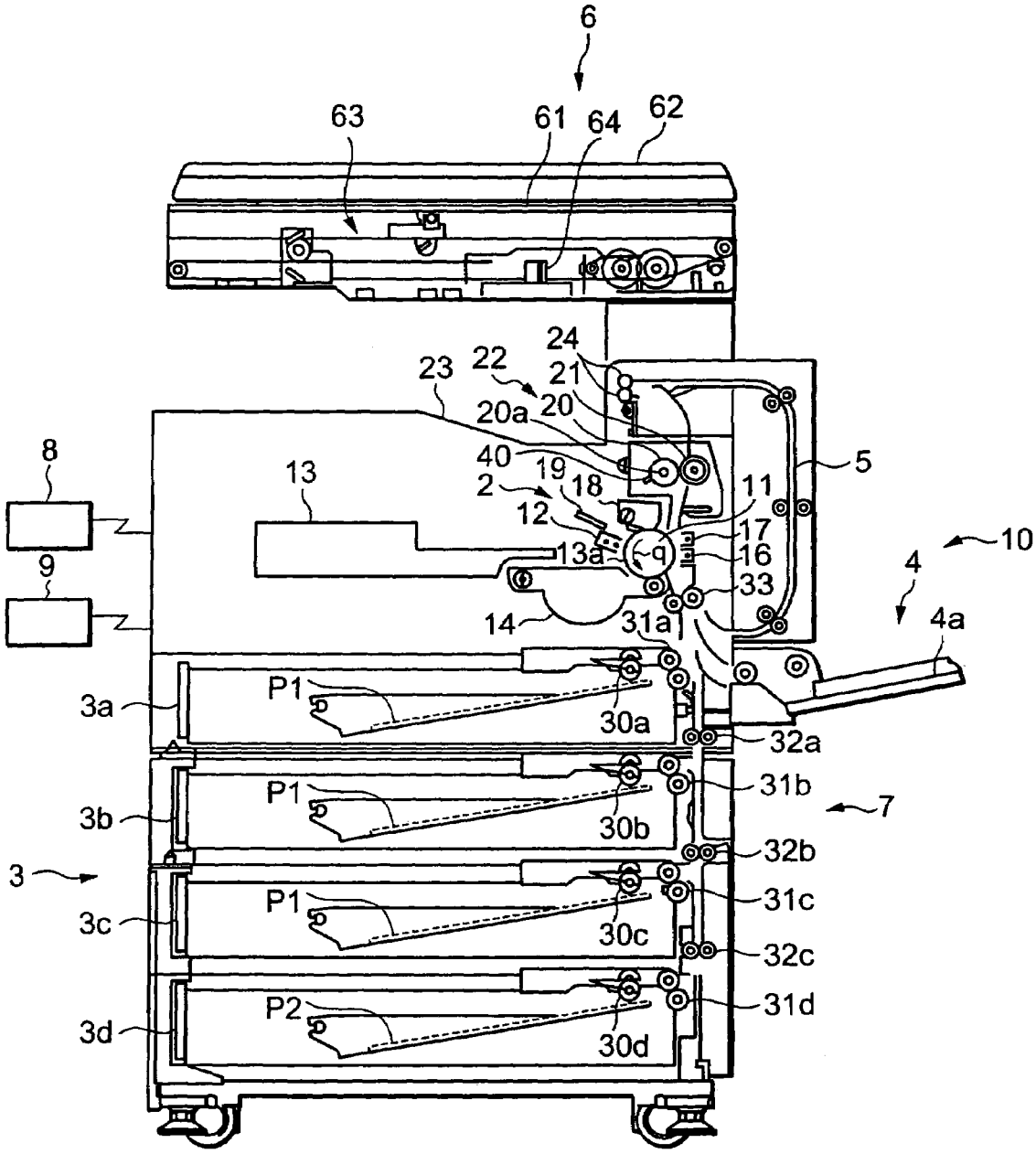
FIG. 1 is a schematic construction diagram showing MFP in an embodiment of this invention.

FIG. 1 is a schematic construction diagram showing a MFP 10 that is an image forming apparatus in an embodiment of this invention. This apparatus comprises an electro-photographic copying machine, a printer and a facsimile integrated in one unit. MFP 10 is provided with a paper supply unit 3 comprising paper supply cassettes 3*a*, 3*b*, 3*c* and 3*d* to supply sheet paper P1 and P2 which are recording media in the direction of an image forming unit 2 which forms unfixed toner images. Further, MFP 10 is provided with a manual paper supply unit to manually supply various kinds of recording media including sheet paper P1, P2, post cards, envelops, etc. from a paper supply tray 4*a* and a reverse conveying path 5 to convey sheet paper P1 and P2 by reversing the front and reverse sides when images are formed on both sides of paper.

MFP 10 forms images according to image data output from a scanner 6 and a terminal computer 8 or fax image data, etc. transmitted through a communication line 9. Scanner 6 has a document glass 61 on which documents are placed, a platen 62 to cover document glass 61, an optical unit 63 to focus reflecting light from document, and a CCD scanner unit 64 to read light from optical unit 63.

Image forming unit 2 has a charger 12 to uniformly charge a photosensitive drum 11 following its rotating direction of arrow q, an exposing unit 13*a* of a laser exposing device 13 to form a latent image on charged photosensitive drum 11 based on image data provided from scanner 6, a developing unit 14, a transfer charger 16, a separation charger 17, a cleaner unit 18, and a charge eliminating LED 18 around photosensitive drum 11. Developing unit 14 develops images using a low melting point toner of glass transfer point 100 to 110° C.

At the downstream in the conveying direction of sheets P1, P2 of image forming unit 2, there are provided a fixing device 22 and a discharge roller 24 to discharge fixed sheets P1, P2 in a discharged document receiving tray 23 in the unit. Fixing device 22 has a heat roller 20 that is a first fixing member having a built-in heater lamp that is a heating member and a press roller that is a second fixing member. Heat roller 20 and press roller 21 are press contacted each other to form a fixing roller pair and convey sheets P1, P2 by clamping and heat press and fix unfixed toner images.

Paper supply cassettes 3*a* to 3*c* at the upper 3 stages of paper supply cassette unit 3 house ordinary sheet paper P1 in various size of 64 to 105 g/cm$^2$ and paper supply cassette 3*d* at the most lower stage houses thick sheet paper P2 in 209 g/cm$^2$. From paper supply cassettes 3*a* to 3*d* to image forming unit 2, there are a conveying path 7 having a pick-up rollers. 30*a*, 30*b*, 30*c* and 30*d* to pick up sheet paper P1, P2, separation conveying devices 31*a*, 31*b*, 31*c*, 31*d* that are paper supply devices having a pair of paper supply roller 37 and separation roller 38, and first to third conveying rollers 32*a*, 32*b*, 32*c*, and aligning rollers 33.

Figure 2:
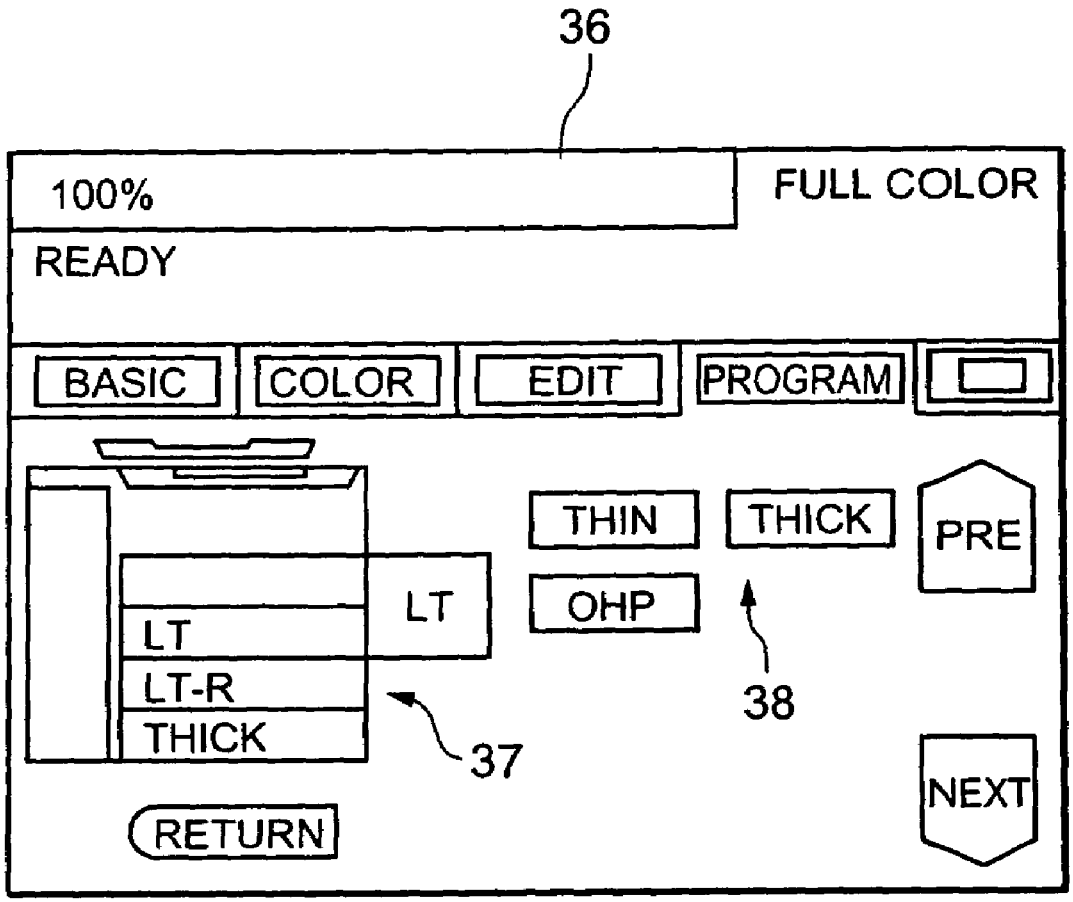
FIG. 2 is a plan view showing one example of the display content of a touch panel of the embodiment of this invention.

On the top surface of MFP 10, a switching portion is constructed together with the control panel and a touch panel 36 is provided to indicate and change heating temperature and pressure force of heat roller 20 and press roller 21 to specified conditions. When setting image forming conditions, a paper supply cassettes 3*a* to 3*d* and kinds of recording media selection screen shown in FIG. 2 is displayed on touch panel 36. A paper supply cassette layout 37, a key layout 38 to designate thickness of sheet paper P1, P2 or OHP paper, etc. are displayed in touch panel 36.

Next, fixing device 22 will be described in detail. A temperature sensor 40 is provided around heat roller 20. Heat roller 20 and press roller 21 is closely contacted each other by a pressing member 41. Heat roller 20 is rotated following the forward direction of a main motor (not shown) through a one-way clutch (not shown).

Figure 3:
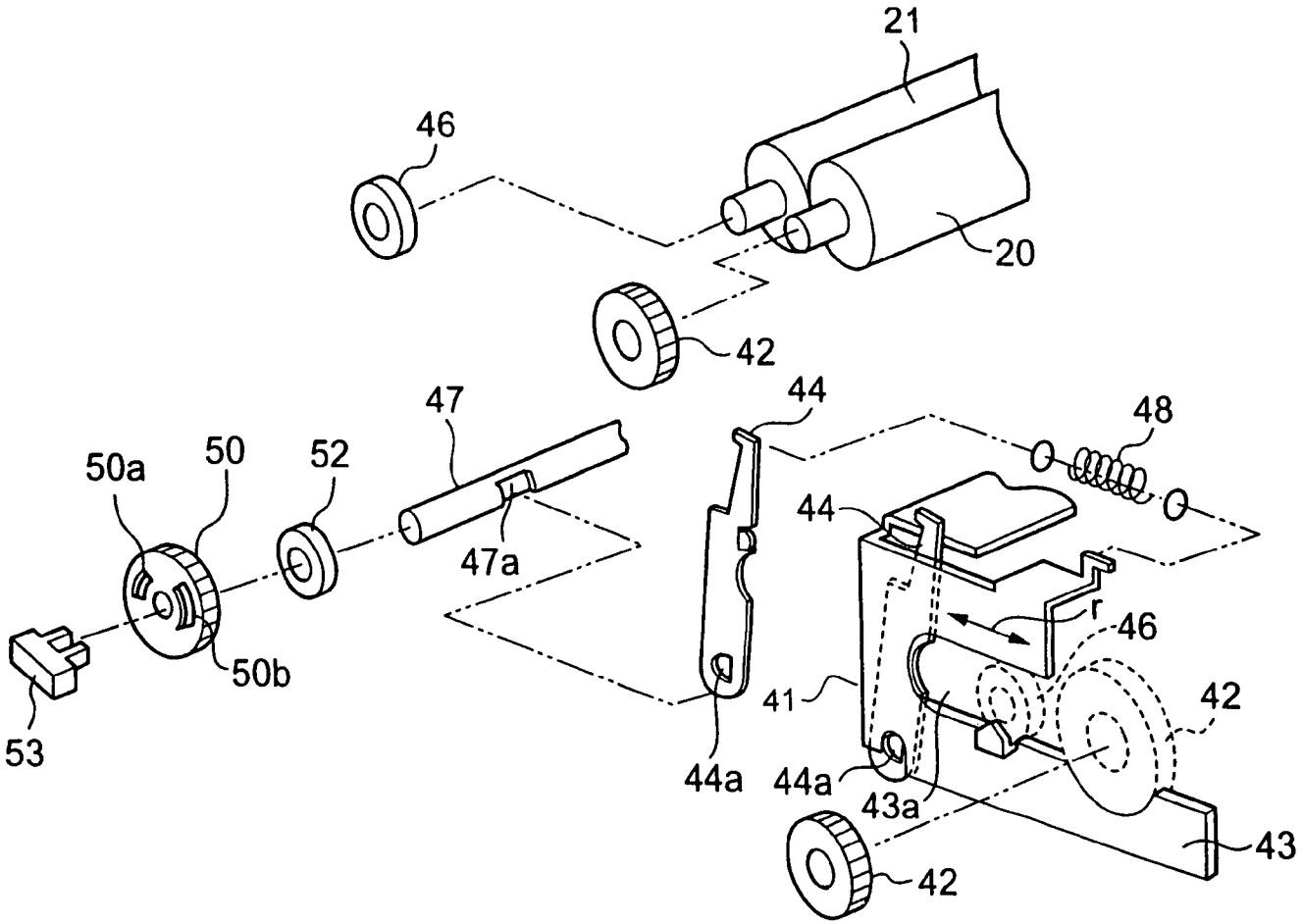
FIG. 3 is an exploded view of the fixing device in the embodiment of this invention.
Figure 4:
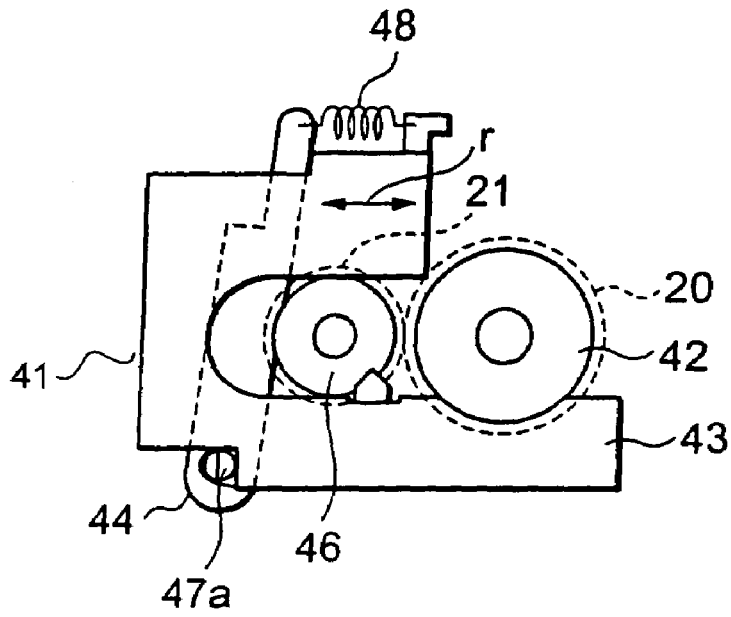
FIG. 4 is a schematic side view showing the pressure member of the fixing device when fixing ordinary sheets in the embodiment of this invention.
Figure 5:
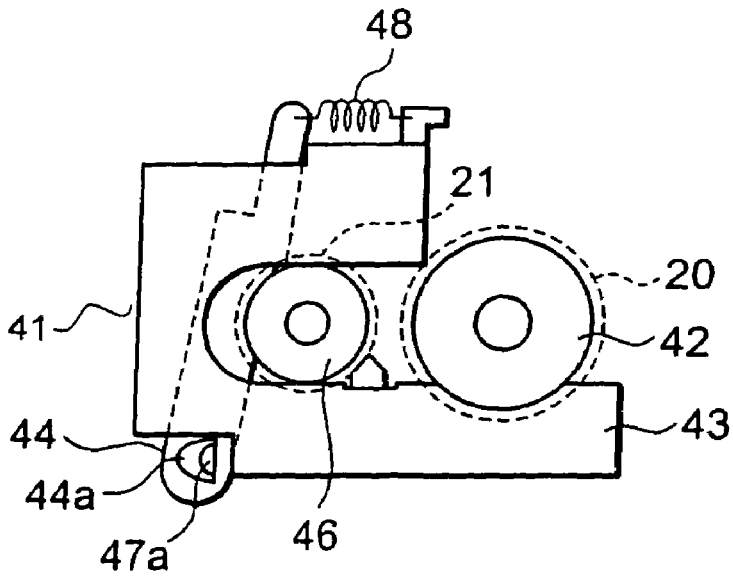
FIG. 5 is a schematic side view showing the pressure member of the fixing device when fixing thick sheets in the embodiment of this invention.

Pressing member 41 has a pressing lever 44 that moves heat roller 20 fixed to a side frame 43 through a first bearing 42 to heat roller 20 by sliding for a relative distance as shown in FIG. 3, FIG. 4 and FIG. 5. The pressing force between heat roller 20 and press roller 21 is switched by switching the pressing position of pressing lever 44 for 2 stages.

Press roller 21 is able to slide in the arrow direction r in a slit 43*a* that is formed in side frame 43 through a second bearing 46 provided at its end. A D-cut cam portion 47*a* of a rotatable pressure switch shaft 47 that is a cam and formed in D-shape section is inserted into a switching portion 44*a* hat is in almost D-shape of pressing lever 44. The end of pressing lever 44 is pressed by a pressing spring 48 in the direction of heat roller 20.

At the end of pressure switch shaft 47, a home position detecting rib 50*a* for detecting the position of D-cut cam 47*a* through one-way clutch 52 and a switching gear 50 with a decompressing position detecting rib 50*b* are installed. The switching gear 50 is rotated by the reverse rotation of the main motor (not shown) that drives photosensitive drum 11 and heat roller 20, etc.

Home position detecting rib 50*a* is formed in the length two time of decompressing position detecting rib 50*b*. A photo-sensor 53 identifies the position of D-cut cam 47*a* by the difference in passing time of home position detecting rib 50*a* or decompression position detecting rib 50*b*.

Figure 6:
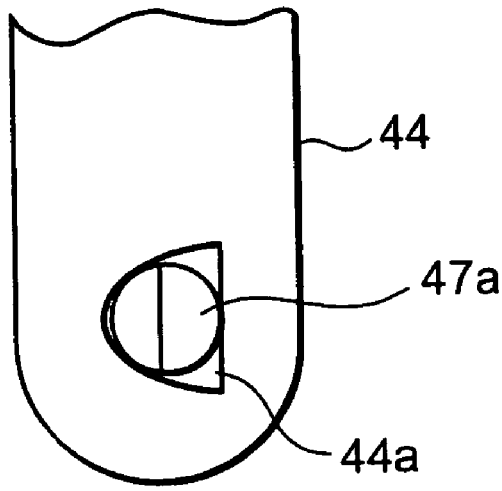
FIG. 6 is a schematic explanatory drawing showing the position of a D-cut cam unit when fixing ordinary sheets in the embodiment of this invention.
Figure 7:
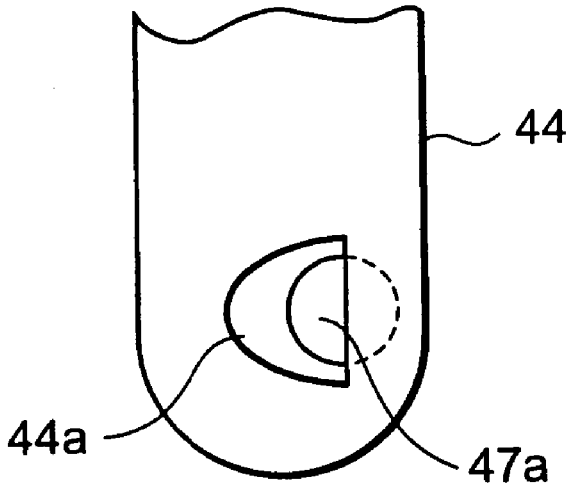
FIG. 7 is a schematic explanatory drawing showing a D-cut cam unit when fixing thick sheets in the embodiment of this invention.

When photo-sensor 53 detects home position detecting rib 50*a*, the circular side of D-cut cam 47*a* comes to contact the flat side of switching portion 44*a* of pressing lever 44 as shown in FIG. 6. At this time, pressing lever 44 is at the position shown in FIG. 4. When photo-sensor 53 detects decompressing position detecting rib 50*b*, the flat side of D-cut cam 47*a* comes to agree with the flat side of switching portion 44*a* of pressing lever 44 as shown in FIG. 7. At this time, pressing lever 44 is at the position shown in FIG. 5.

Accordingly, when photo-sensor detects home position detecting rib 50*a*, an elongating amount of a pressure spring 8 becomes large and the pressing force between heat roller 20 and press roller 21 is increased to 1.4 kg/cm$^2$. When photo-sensor detects decompressing position detecting rib 50*b*, switching portion 44*a* moves by amount of D-cut and the pressure applied to second bearing 46 is decreased by pressing lever 44 and pressing force between heat roller 20 and press roller 21 is decreased to 1.1 kg/cm$^2$.

Figure 8:
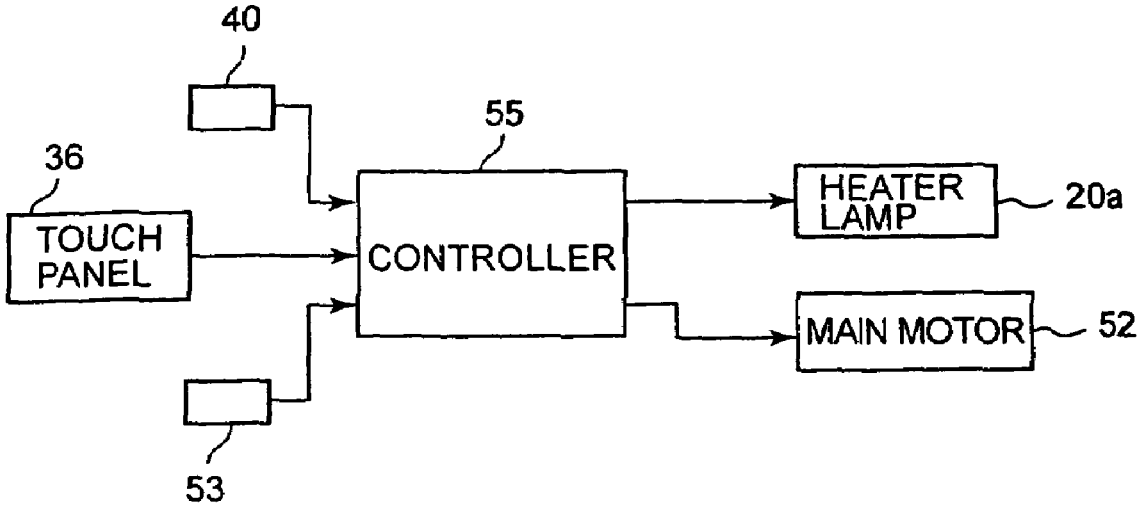
FIG. 8 is a block diagram showing the control system of the fixing device in the embodiment of this invention.

FIG. 8 is a block diagram showing the control system of fixing device 22. Image forming conditions from touch panel 36 are input to a controller 55. Further, the detecting result from temperature sensor 40 and that from photo-sensor 53 are input to controller 55. Heater lamp 20*a* and a drive motor 52 are connected to the output side of controller 55.

Next, the actions will be described. In the ready state, the fixing device is initialized so as to fix ordinary sheet P1. When fixing images on ordinary sheet paper P1, heat roller 20 is set at a temperature 175 to 185° C. by the on/off control of heater lamp 20*a*. Further, pressing lever 44 of pressure member 41 is at the position shown in FIG. 4 and the pressing force between heat roller 20 and press roller 21 is largely set at 1.4 kg/cm$^2$.

When the image forming process is started, image forming conditions are set. The number of image forming sheets is input through the control panel and a type of paper to be used is selected through touch panel 36. When paper is supplied from cassette apparatus 3, a specified paper supply cassette is selected through a paper supply cassette layout 37 on the screen of the touch panel 36 shown in FIG. 2. To supply paper manually, a type of recording medium is selected on a key layout portion 38. Conditions for recording media from touch panel 36 are input to controller 55.

When a type of paper is selected through touch panel 36, paper supply cassettes 3*a* to 3*d* are selected in the cassette apparatus 3 and both fixing conditions of temperature and pressure are switched and controlled in fixing device 22.

Figure 9:
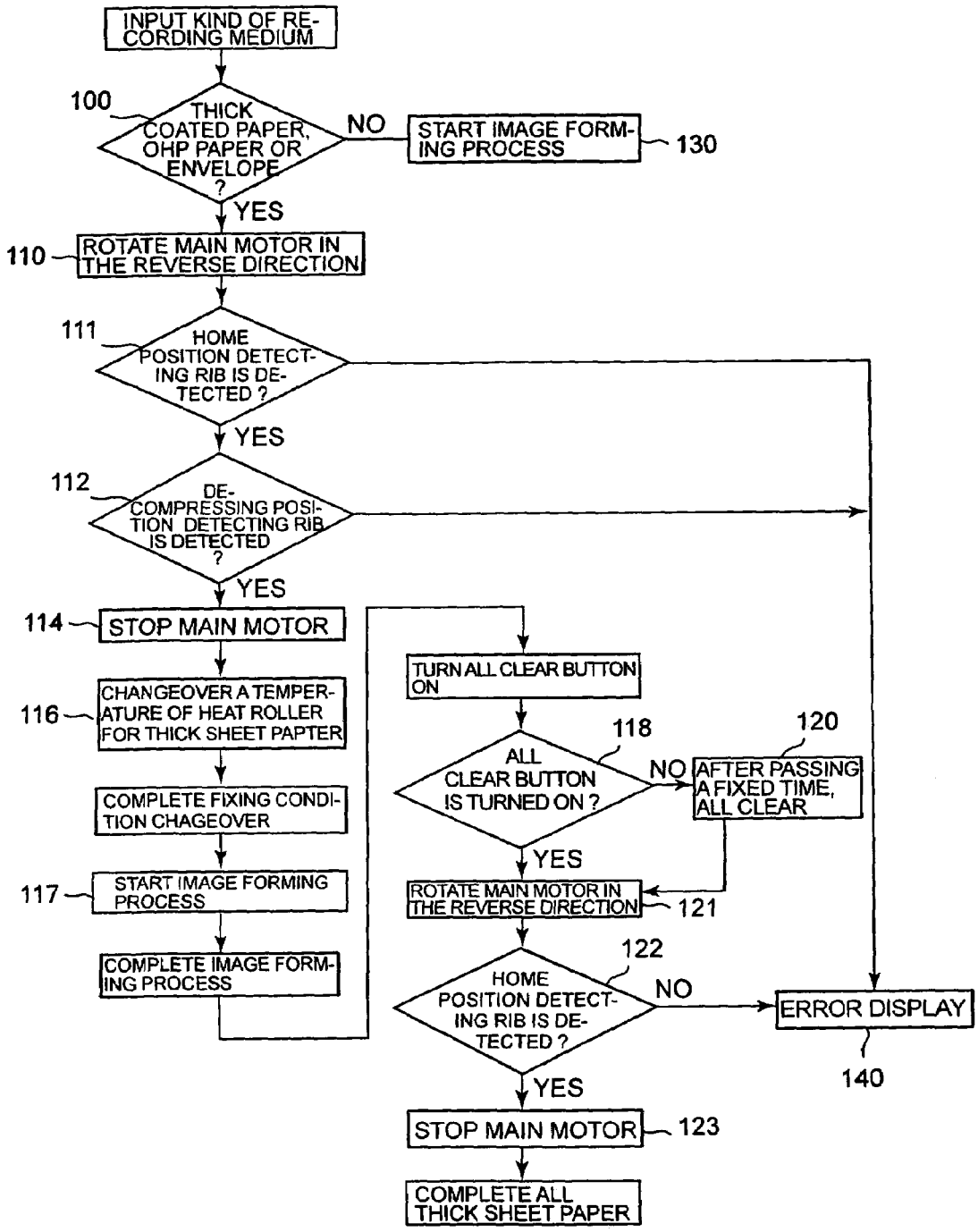
FIG. 9 is a flowchart showing the fixing condition switching operation of the fixing device in the embodiment of this invention.

Next, the switching control of fixing device 22 by controller 55 will be described referring to a flowchart shown in FIG. 9. When a type of recording medium is input through touch panel 36, proceeding to Step 100, the selected recording medium is determined whether it is ordinary sheet paper P1 or thick sheet paper P2 or OHP paper or envelope. Then, one of paper cassettes 3*a* to 3*c* of the upper 3 stages is selected through paper supply cassette layout portion 37 and when ordinary sheet paper P1 is selected, proceeding to Step 130, the image forming process starts similarly to Step 117 described later without controlling fixing device 22 again.

When the selected recording medium is thick sheet paper P2 or OHP paper or envelope, before starting the image forming process, proceed to Step 110 for switching a heating temperature of heat roller 20 and decreasing pressing force between heat roller 20 and press roller 21.

For example, to form images on thick sheet paper P2, paper supply cassette 3*d* at the lowest stage on paper supply cassette layout portion 37 is selected. Thus, the selection of thick sheet P2 is discriminated in Step 100 and the main motor is driven in the reverse direction and pressure switching shaft 47 is rotated in Step 110. At this time, heat roller 20 is not rotated. Then, proceeding to Step 111, whether photo sensor 53 detects home position detecting rib 50 is determined. If it was not detected after passing a specified time, proceeding to Step 140, the error display is made on touch panel 36 and the main motor is stopped to drive.

When home position detecting rib 50*a* is detected, proceeding to Step 112, whether photo sensor 111 detects decompression position detecting rib 50*b* is checked. When it was not detected after passing a specified time, proceeding to Step 140, the error display is made on touch panel 36 and the main motor is stopped to drive. At this time, the flat side of D-cut cam 47*a* of pressing member 41 is in accord with the flat side of switching portion 44*a* of pressing lever 44 as shown in FIG. 7. Accordingly, pressing lever 44 is at the position shown in FIG. 5 and the pressing force between heat roller 20 and press roller 21 is switched to 1.1 kg/cm$^2$.

Then, the temperature setting of heat roller 20 is changed to 180 to 190° C. in Step 116. Fixing device 22 switches the fixing conditions for thick sheet paper P2 and proceeding to Step 117, the image forming process is executed.

In image forming unit 2, photosensitive drum 11 is rotated in the arrow direction q by the forward rotation of the main motor. When rotated in the arrow direction q, photosensitive drum 11 is uniformly charged by charger 12 and then, applied with laser beam from laser exposing unit 13 corresponding to a document read by scanner 6, document data from computer 8 or communication line 9 and an electrostatic latent image is formed. Then, the electrostatic latent image is developed by developing unit 14 and an unfixed toner image is formed on photosensitive drum 11.

On the other hand, in paper supply cassette unit 3, a thick sheet paper P2 is taken out by pick-up roller 30*d* from paper supply cassette 3*d* of the lowest stage. The taken out sheet paper P2 is conveyed in the direction of an aligning roller 33 via a separation conveyor 31*d*, conveying rollers 32*a* to 32*c*. However, in the image forming process in Step 130, ordinary sheet paper P1 is taken out from one of paper supply cassettes 3*a* to 3*c* of upper 3 stages of paper supply cassette unit 3 and conveyed in the direction of aligning roller 33.

Sheet paper P2 of which edge aligned by aligning roller 33 is conveyed to transfer charger 16 in synchronous with an unfixed toner image on photosensitive drum 11 and separated from photosensitive drum 11 by a separation charger 17 after a toner image is transferred. After separating sheet paper P2, photosensitive drum 11 is cleaned with a cleaner unit 18 by removing residual toner, residual charge is eliminated by charge eliminating LED 19 and waits the next image forming process. Sheet paper P2 with an unfixed toner image formed and separated from photosensitive drum 11 is inserted between heat roller 20 and press roller 21 of fixing device 22 and the toner image is heated, pressed and fixed.

At this time sheet paper P2 is heated, pressed and fixed under fixing conditions suited to thick sheet paper P2; that is, a heater lamp temperature 180 to 190° C. and a pressing force 1.1 kg/cm$^2$ between heat roller 20 and press roller 21. Thus, a good fixed toner image is obtained without causing shrink or wrinkle of thick sheet paper P2. However, in the image forming process of ordinary sheet paper P1 in Step 130, images are heated, pressed and fixed under fixing conditions suited to ordinary sheet paper P1; that is, a heater lamp temperature 175 to 185° C. and pressing force 1.4 kg/cm$^2$ between heat roller 20 and press roller 21. Thus, a good fixed toner image on ordinary sheet paper P1 is obtained without cause defective fixing.

After fixing, thick sheet paper P2 is discharged on discharged document receiving tray 23 by discharge roller 24, the image forming process is thus completed and the main motor is stopped to rotate. However, in the case of the image forming on both sides of paper, sheet paper P2 is sent to reverse conveying path 5 side and the image forming on the reverse face is executed.

Next, an all clear button is turned on to return fixing device 22 to the initial setting. As a result, heat roller 20 is set at a fixing temperature for ordinary sheet paper P1 by the on/off control of heater lamp 20*a*. In Step 118, it is checked whether the all clear button is turned ON. When the all clear button was turned ON, the operation proceeds to Step 121. When the all clear button was not turned ON, the operation proceeds to Step 120 and MFP 10 is cleared completely after a specified time passed and the operation proceeds to Step 121. In Step 121, the main motor is driven to rotate in the reverse direction and pressure switching shaft 47 is rotated. At this time, heat roller 20 is not rotated. Then, proceeding to Step 122, whether photo sensor 53 detected home position detecting rib 50*a* is checked. When the rib 50*a* was not detected after passing a specified time, proceeding to Step 140, the error is displayed on touch panel 36 and the driving of the main motor is stopped.

When home position detecting rib 50*a* was detected, proceeding to Step 123, the driving of the main motor is stopped. At this time, the flat side of D-cut cam 47 is in contact with the flat side of switching portion 44*a* of pressing lever 44 as shown in FIG. 6. Accordingly, pressing lever 44 is as the position shown in FIG. 4 and the pressing force between heat roller 20 and press roller 21 is set at 1.4 kg/cm$^2$ that is a fixing pressing force of ordinary sheet paper P1. Fixing device 22 is returned to the initial fixing temperature and pressing force and a series of image forming process of thick sheet paper P2 are all completed.

Further, to make the image forming on manually supplied OHP paper or envelops, etc., before staring the image forming process, select OHP paper or thick paper on the key layout portion 38 of touch panel 36. Fixing device 22 executes Steps 110 to 123 similarly to thick sheet paper P2 and makes the fixing on OHP paper or envelops under the optimum fixing conditions.

According to this embodiment, when switching the fixing conditions of fixing device 22 so as to suite to type of recording medium such as sheet paper P1, P2, operator is able to switch and control the both of a fixing temperature of heat roller 20 and a pressing force between heat roller 20 and press roller 21 by controller 55 only when selecting a recording medium for image forming through touch panel 36. Accordingly, operator is not required to operate the lever for switching fixing pressure separately from the fixing temperature switching through the touch panel as in a conventional device and an image forming apparatus of good operability in switching fixing conditions of fixing device 22 is obtained. Further, according to this embodiment, the main motor is a source of driving switching gear 50 and a new source of driving is not required to drive switching gear 50 and thus, it becomes possible to achieve the cost saving.

Further, this invention is not restricted to the embodiment described above but can be modified variously within the scope of this invention. For example, fixing conditions suited to various kinds of recording media such as ordinary sheets, thick sheets, envelops, etc. vary depending on toner characteristics. When a toner having a high glass transition point is used, heating temperatures may be raised and pressing force also may be increased higher than those for ordinary sheets and envelops according to characteristics of toners.

Further, the changeover of fixing conditions suited to various types of recording media is not restricted to 2 stages. In the embodiment described above, for example, the heating temperature of the heat roller was the same for fixing thick sheet paper, envelops and OHP paper but may be changed for every type of recording medium so as to make the fixing condition suite to material and shape of each recording medium. Further, the pressing force between fixing members may be changed over for every type of recording medium by changing a relative distance between fixing members into plural stages using multi-stage cam members.

Further, the changeover portion to direct the changeover control of fixing temperatures and pressures of fixing members is not restricted to the touch panel but optional; for example, temperatures and pressures may be changed over by the key input through the control panel. In addition, in the above-mentioned embodiment, a driving source for shifting the pressing force of pressing members is not restricted to the main motor but an exclusive driving motor may be used. Further, the fixing members are not restricted to roller type members but may be belt shape fixing members. Also, pressing members or heating members are not restricted but plungers may be used instead of a pressing lever for moving a relative distance between the heat roller and the press roller in the above-mentioned embodiment.

As described above, according to this invention, when controlling heating temperature and pressing force of fixing members properly according to thickness, shape or material of recording media, both of temperature and pressure can be changed only by one time of indicating operation without changing heating temperature and pressure independently. Accordingly, the operability of changeover of fixing members can be improved and the heating, pressing and fixing under more suitable fixing conditions for every recording medium can be easily achieved and a fixed toner image of high quality can be obtained.

What is claimed is:

1. An image forming apparatus, comprising:

an image forming unit to form unfixed toner images on plural kinds of recording media;

a fixing roller pair to hold and convey the recording media;

a pressing member to press contact the fixing roller pair with each other by a specified pressing force, the pressing member including a cam to move a relative distance of the fixing roller pair by rotating, and press contacting the fixing roller pair mutually with a prescribed pressing force by detecting a rotating position of the cam;

a heating member to heat the fixing roller pair; and a changeover portion to change over the pressing force by the pressing member and a heating temperature by the heating member to specified conditions by the same indicating operation according to a thickness or shape of the recording media.

2. The image forming apparatus according to claim 1, wherein the cam is a D-cut cam.

3. An image forming method, comprising:

press contacting plural kinds of recording media having unfixed toner images with each other with a specified pressing force;

holding and conveying the plural kinds of recording media by a fixing roller pair heated to a specified heating temperature;

obtaining fixed toner images on the plural kinds of recording media and changing the pressing force and the heating temperature over to specified conditions by the same indicating operation according to a thickness or shape of the recording media, wherein changing the pressing force is performed by using a cam to move a relative distance of the fixing roller pair by rotating, and press contacting the fixing roller pair mutually with a prescribed pressing force by detecting a rotating position of the cam.

4. An image forming apparatus, comprising: an image forming unit that forms unfixed toner images on plural kinds of recording media;

a fixing roller pair that holds and conveys the plural kinds of recording media;

a pressure changeover unit that changes over a pressing force of the fixing roller pair, the pressure changeover unit having a cam to move a relative distance of the fixing roller pair by rotating and press contacting the fixing roller pair with each other with a specified pressing force by detecting a rotating position of the cam;

a heating member that heats the fixing roller pair;

a key operating portion that selects a specified recording medium from the plural kinds of recording media; and a controller to change over the pressing force by the pressure changeover unit according to a thickness or shape of the recording medium selected by the key operating portion and a heating temperature of the heating member.

* * * * *